US005927028A

United States Patent [19]

Rossi

[11] Patent Number: 5,927,028

[45] Date of Patent: Jul. 27, 1999

[54] DOUBLE INTERLOCKING STORM PANEL

[76] Inventor: Jose E. Rossi, Z-20 Hasting, Garden Hills, San Juan, Puerto Rico 00966

[21] Appl. No.: 08/882,193

[22] Filed: Jun. 25, 1997

[51] Int. Cl.[6] ..... E06B 9/00; E04C 2/32

[52] U.S. Cl. ..... 52/202; 52/588.1; 52/522; 52/478; 52/579

[58] Field of Search ..... 52/202, 203, 520, 52/521, 522, 529, 588.1, 579, 478

[56] References Cited

U.S. PATENT DOCUMENTS

| | | | |
|---|---|---|---|
| 877,639 | 1/1908 | Galbraith . | |
| 1,329,794 | 2/1920 | Moomaw . | |
| 1,913,342 | 6/1933 | Schaffert . | |
| 3,110,371 | 11/1963 | De Ridder . | |
| 3,218,773 | 11/1965 | Heirich | 52/521 |
| 3,392,486 | 7/1968 | Luke . | |
| 3,524,292 | 8/1970 | Bottom | 52/522 |
| 3,606,720 | 9/1971 | Cookson . | |
| 3,660,482 | 5/1972 | Elizalde . | |
| 4,043,088 | 8/1977 | Payton | 52/529 X |
| 4,099,357 | 7/1978 | Lester . | |
| 4,685,261 | 8/1987 | Seaquist . | |
| 5,165,213 | 11/1992 | Finch et al. | 52/520 X |
| 5,201,158 | 4/1993 | Bayley et al. | 52/521 X |
| 5,345,716 | 9/1994 | Caplan . | |
| 5,487,244 | 1/1996 | Hill . | |
| 5,524,409 | 6/1996 | Kaiser . | |

FOREIGN PATENT DOCUMENTS

| | | | |
|---|---|---|---|
| 1120106 | 12/1961 | Germany | 52/522 |

*Primary Examiner*—Carl D. Friedman
*Assistant Examiner*—Winnie S. Yip

[57] ABSTRACT

A storm window or a roof or wall section of a building is formed form a plurality of double interlocking panels, each panel having left and right side strip sections of specific cross-sectional shapes that a locking force is developed between two panels when engaged at the strip sections. The locking force developed is proportional to a load applied against the panels. This increase in locking force between panels allows for the panels to be made from lighter stock material, yet still maintain the structural integrity that would normally be found in a heavier stock material.

18 Claims, 4 Drawing Sheets

DOUBLE INTERLOCKING STORM PANEL

BACKGROUND OF THE INVENTION

The present invention relates to a removable storm panel for use in protecting windows and the like during storms such as hurricanes or tornadoes. The panel can also be used as a roof panel or a wall panel in pre-fabricated buildings.

Non-interlocking (FIG. 6) and single interlocking (FIG. 5) panels for hurricane protection systems have been available commercially for years in the U.S. and the Caribbean islands for protection against hurricane forces on wall openings, glass panels and panes in windows and doors and other types of openings, furnishings and appurtenances on building walls and roofs. Most of these prior art systems have good resistance to storm forces, and will withstand the high positive pressures acting against the walls and roofs as a result of hurricane action. However, none of them will withstand the high negative pressures (suction force) developed by a hurricane wind unless they are structurally reinforced or fabricated from heavy and costly metal or plastic materials. Thus, the prior art panels lack a two-way protection in that they are structurally sound in only one direction of force—either positive pressure or negative pressure but not both.

The non-interlocking and single interlocking panel systems available in the industry have been increased in thickness through the last four years and recommended spans between supports have been decreased in order to comply with increasing requirements of local and area building code regulations. Aluminum panels have been increased in thickness from 0.050 to 0.060, 0.062, 0.072, and 0.080 inches thick sheets. Steel panels have been increased from gage 26 to gage 24, 22 and 20. All of these changes are a result of changes resulting from increased ordinances and civil consciousness of the devastating effect of high intensity hurricane forces—particularly in coastal zones, on unprotected wall and roof openings, doors and windows—have resulted in constantly increasing costs for heavier protection systems and additional structural elements designed to cut down the span between supports for even these heavier panels. Yet the non-interlocking and single interlocking panel systems have remained inherently weak in their resistance to the negative or suction pressure exerted by hurricane winds, even with the additional structural support added due to required local or area regulations.

SUMMARY OF THE INVENTION

One of the objectives of the present invention is to provide for a storm panel which will provide structural support against forces acting on either side of the panel—either positives pressures causing a load acting against the front side or negative pressures causing a load acting against the back side.

Another objective of the present invention is to provide for a storm panel having the above described double load properties without having to increase the thickness of the sheet metal used in the panel, or without having the shorten the length or width of the panel members, or without having to add reinforcement to a panel.

Another objective of the present invention is to provide a storm panel which is easily and quickly inserted into its mount on the window or opening for which protection from the storm is sought.

The above objectives are obtained by using a plurality of interlocking panel members to from the storm window panel assembly. The panel members each have specially designed grooves on each side which engage with grooves of another panel member in a locking manner. The grooves are of such shape and design that when a load is applied against the storm paneling, the force of the locking capabilities of the grooves is increased as the force increases. Thus, the ability of each panel member to interlock with adjacent panel members is increased as the force acting against the panels is increased. This increase of the interlocking force of the panel members works for forces acting against the front or the back of the storm panel.

Mounting of the assembled panels into the opening is provided by U-shaped channel permanently mounted to the top side of the opening, and an L-shaped channel permanently mounted to the bottom side of the opening. Both channels have holes which receive bolts therein. The assembled storm paneling is first inserted into the top channel, and then pivoted into position against the bottom channel. Holes in the storm paneling are aligned with the bolts in the channels such that nuts are used to secure the panels in place.

The ability of the storm panels using the double interlocking features of the present invention to withstand high negative (suction) pressures rose dramatically over the same type, material, size, thickness and configuration of all panels previously tested without using the double-interlocking feature. Thus, the present invention provides for the panels of the prior art to have increased structural strength without having to increase the thickness of the panels or decrease the size of the panels.

The panels of the present invention can also be used as roofing panels or side wall panels in pre-fabricated buildings.

DETAILED DESCRIPTION.

Figure 1:
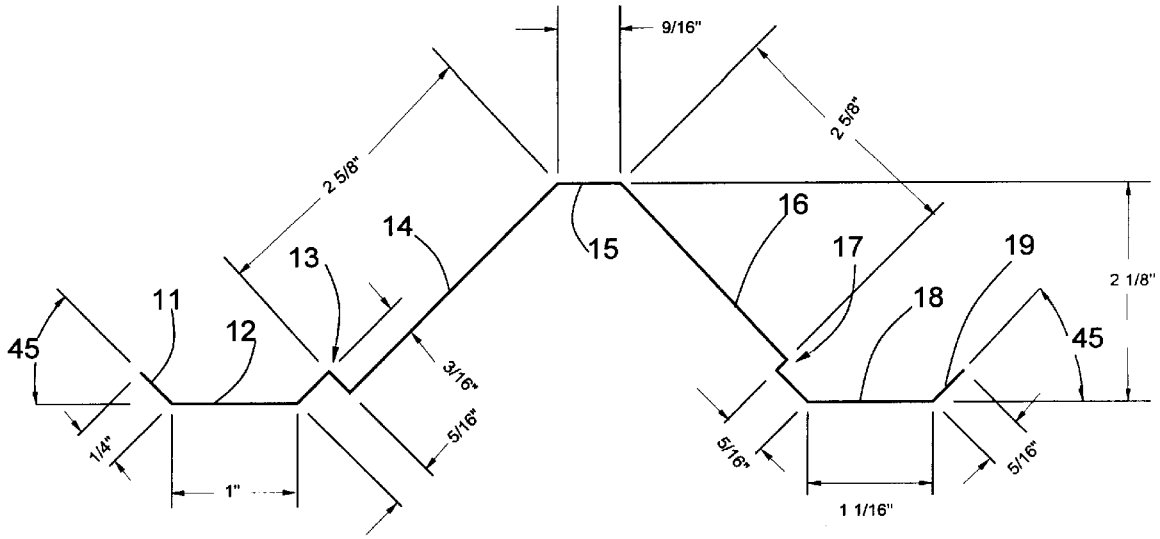
FIG. 1 shows a cross-section of a single panel having the double-interlocking capabilities of the present invention.
Figure 9:
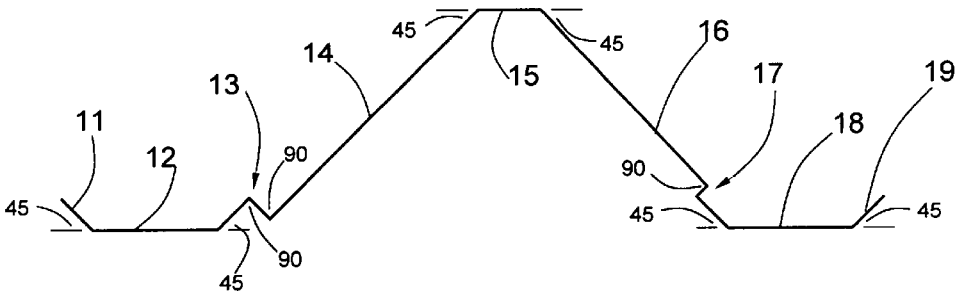
FIG. 9 shows a cross-section of the panel of the present invention.
Figure 10:
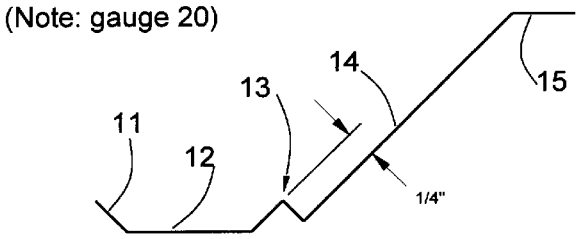
FIG. 10 shows the left side engaging edge of the panel of the present invention.
Figure 2:
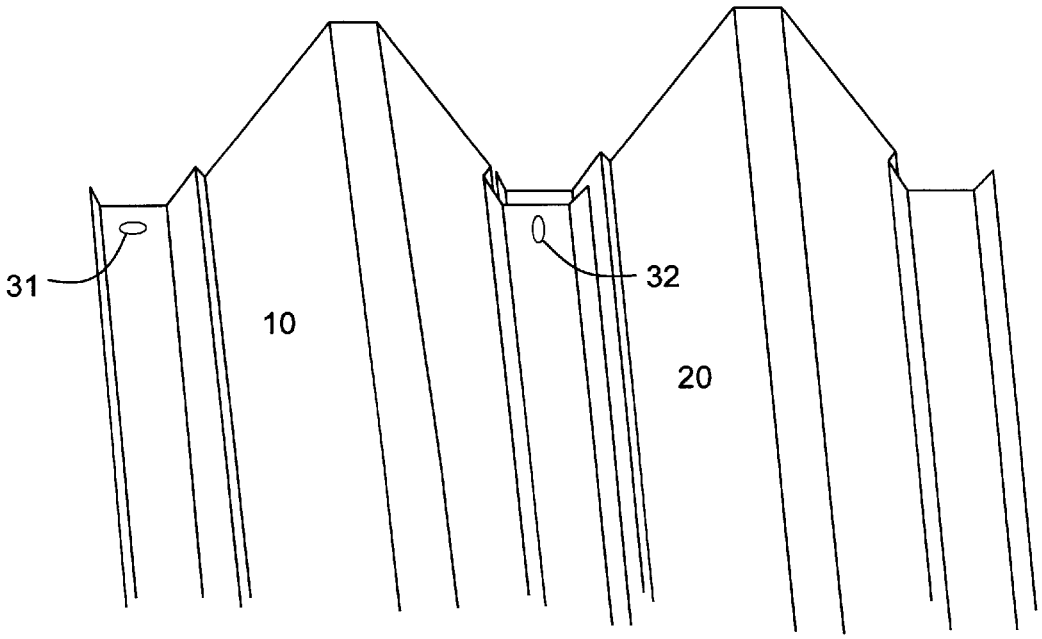
FIG. 2 shows two of the panels having the double-interlocking capabilities in engagement.

FIG. 1 shows a cross section of one of the panels incorporating the double-interlocking features of the present invention. The panel 10 includes a left flange 11, a lower left strip 12, an inner offset bend 13, a left side 14, an upper flat strip 15, a right side 16, an outer offset bend 17, a lower right strip 18, and a right flange 19. The left flange 11, lower left strip 12, and the inner offset bend 13 form a left side engaging edge of the panel 10, while the outer offset bend 17, the lower right strip 18, and the right flange 19 form a right side engaging edge of the panel. The upper flat strip 15 and the left 14 and right 16 sides form a middle or center section of the panel which has a concave cross-sectional shape facing towards the bottom of the page in FIG. 1, while the lower right strip and the right flange form a right side section of the panel. The left and right side sections form a concave cross-sectional shape which faces upwards in the figure and opposite to the direction of the concave section of the middle section. The dimensions of the sections on the panel are as follows (starting with the left end of the panel in FIG. 1 and ending with the right end): left flange 11 is ¼ inch in length an 45 degrees in angle; the lower left strip 12 is 1 inch; the inner offset bend 13 is 5/16 inch in length and 3/16 inch in length with 90 degrees between the two members; the left side 14 is 2⅝ inches in length and 45 degrees; the upper flat strip 15 is 9/16 inches in length; the right side 16 is 2⅝ inches in length and 45 degrees; the outer offset bend 17 is 3/16 inches and 5/16 inches in length and 90 degrees between the two members; the lower right strip 18 is 1 1/16 inches in length; and the right flange 19 is 5/16 inches in length and 45 degrees. The above dimensions are for gauge 24 sheet metal. If gauge 20 sheet metal is used, then the second surface in the inner offset bend 13 will be ¼ inch in length instead of the 3/16 inches shown in FIG. 1. The height of the cross-sectional shape of the panel as shown in FIG. 1 is 2 inches, but can vary from 2 inches to 2⅞ inches. The panel is made from a flat stock having a width of 9⅞ to 12 inches. If the panel is to used for a roof panel or side wall of a structure, then the flat stock used would be 16 inches to 24 inches in width, the dimensions of the cross section of the panel being proportional to the dimensions of the width of the flat stock. In multiple engaging panels, the left side engaging edge of one panel will be inserted into the right side engaging edge of a second panel. FIG. 2 shows this engagement.

In FIG. 2, two of the double-interlocking panels are shown in engagement. The space between the two panels is exaggerated for purposes of display. A second panel 20 having the same cross sectional shape and size as the first panel 10 is engaged with the first panel 10. The left side engaging edge of the second panel 20 is inserted into the right side engaging edge of the first panel 10. When a force acting against the front face or the back face of the panels 10 and 20 is applied, the locking force created by the inventive shape of the left and right side engaging edges is increased. This increased locking force acts to hold the two panels together during the storm.

Figure 3:
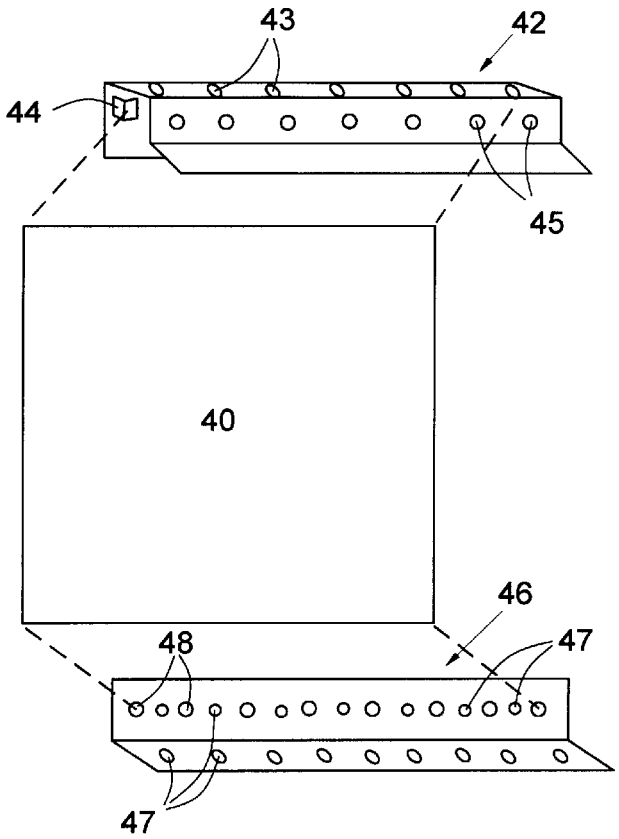
FIG. 3 shows the storm panel assembly mounted on a wall opening.

FIG. 2 also shows holes 31 and 32 located on the bottom ends of the panels. These holes are used to mount the panels to the bottom channel shown in FIG. 3. Hole 31 of one panel will be aligned with hole 32 of another panel when a plurality of panels are interlocked together. Holes 31 and 32 are not circular but elliptical in shape. Hole 31 is ⅜ inch in diameter in the top-to-bottom direction, and ⅝ inch in diameter in the side direction. The center of hole 31 is located 7/16 inches from the top edge of the panel. Hole 32 is the shape of hole 31 but offset 90 degrees. Hole 32 has a diameter of ⅝ inches in the top-to-bottom direction and ⅜ inches diameter in the side direction. Hole 32 is located 5/16 inches from the top edge of the panel. Both holes are centered along the flat surface of the respective lower strip, and are offset from each other by 6 inches. In FIG. 3, a wall opening 40 is shown. The wall opening could be either an opening, a window with glass panes, or a door.

Above the wall opening 40 is mounted a U-shaped upper channel 42 or "Z-bar" permanently screwed or bolted to the building approximately 31½ inches from the top of the wall opening. The upper channel 42 has a plurality of holes 43 arranged along the back side and the top side of the channel as shown in FIG. 3. These holes 43 will accept a concrete screw such as a tapcon™ screw to hold the upper channel 42 on the wall. Holes 43 are of a diameter 1/16 inches less than the diameter of the tapcon™ or concrete screw. The holes on the back are used to secure the channel to a vertical wall surface, while the holes on the top can be used to secure the channel to a vertical service such as a window sill. Holes 45 on the front surface of the upper channel 42 are used to fit a drill bit through in order to secure the concrete screws into the holes 43 on the back surface. Holes 45 are larger in diameter than the holes 43 in order to accommodate the drill bit. The upper channel 42 also has two end stops 44—one at each end of the channel—in which the top ends of the multiple panel arrangement are engaged therewith.

A lower angle 46 or channel with studs 48, also permanently secured to the building, is located below the opening 40 approximately 3½ inches from the bottom edge of the wall opening. The lower channel 46 has a plurality of pre-punched holes 47 on both side and bottom surfaces at 6 inch intervals for installing the channel against the wall or the floor. Also, the side surface of the bottom channel 46 has a plurality of holes with studs 48 at 6 inch intervals. The studs are hydraulically pressed into the holes, and therefore the holes have a slightly smaller diameter than does the studs. The studs 48 will engage the holes 31 and 32 of the panels in order to secure the bottom sides of the panels to the bottom channel 44.

To install the plurality of double-interlocking panels to the channels, a plurality of panels are first interlocked together by placing the left side engaging edge of one panel into the right side engaging edge of another panel. Two or more panels can be engaged to form a storm cover for a window. The assembly of panels are then pushed into the upper channel 42 and up against the end stops 44, while the lower end of the panel is inserted into the studs 46 on the lower angle or channel 44. Wing nuts or other type nuts or fasteners are used to hold the panels securely to the lower channel 46 member via the studs 46.

Figure 4:
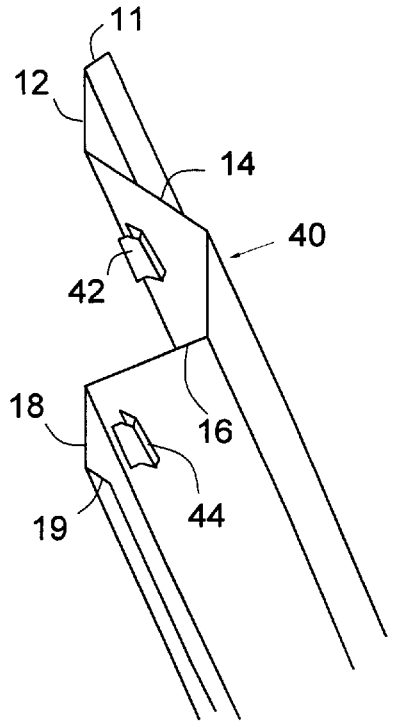
FIG. 4 shows a second embodiment of the double-interlocking panel.
Figure 8:
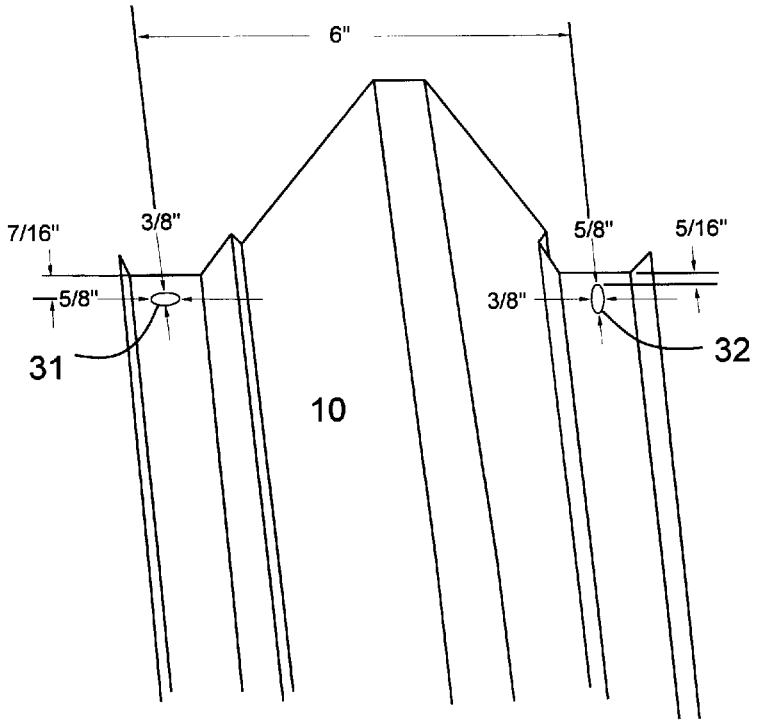
FIG. 8 shows the rear of the half of the panel of the present invention.
Figure 5:
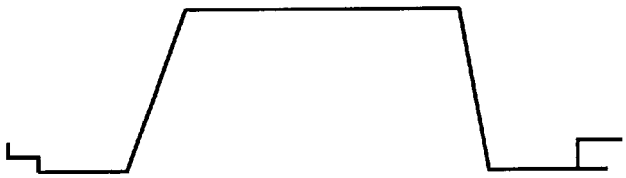
Fig. 5 Prior Art
FIG. 5 shows a cross section of a single interlocking panel of the prior art.
Figure 6:
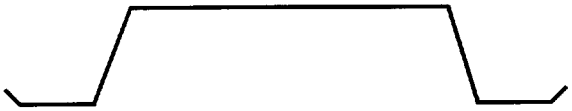
Fig. 6 Prior Art
FIG. 6 shows a cross section of a non-interlocking panel of the prior art.

FIG. 4 shows a second embodiment of the present invention. The panel 40 in FIG. 4 does not make use of the inner 13 or outer 17 offset bends as does the panel 10 of the first embodiment. Instead, FIG. 4 shows the panel 40 to have an internal clip 42 punched out from the left side portion 14 of the panel. The punched out clip is repeated for every 12 inches along the length of the panel. On the right side section 16 of the panel 40 is located an external clip 44, which is also repeated every 12 inches along the right side section 16 of the panel. Each clip measures approximately 1½ inches in width by 1½ inches in length. When two of the panels in FIG. 4 are assembled, the right flange 19 of the first panel will fit in the internal clip 42 of the second panel, while the left flange 11 of the second panel will fit in the external clip 44 of the first panel. The panel 40 in the second embodiment also makes use of the holes 31 and 32 as shown in FIG. 2 located on the bottom ends of the panels for securing the panels to the studs extending from the lower channel 46.

The double interlock system of the present invention can be incorporated into any type of material and method of fabrication, including steel, aluminum and other metallic materials, as well as lexan, PVC and other types of plastic material. Methods of fabrication and manufactured parts and components include extrusions, roll forming, die forming and other similar methods of forming and shaping metal and plastic materials.

Figure 7:
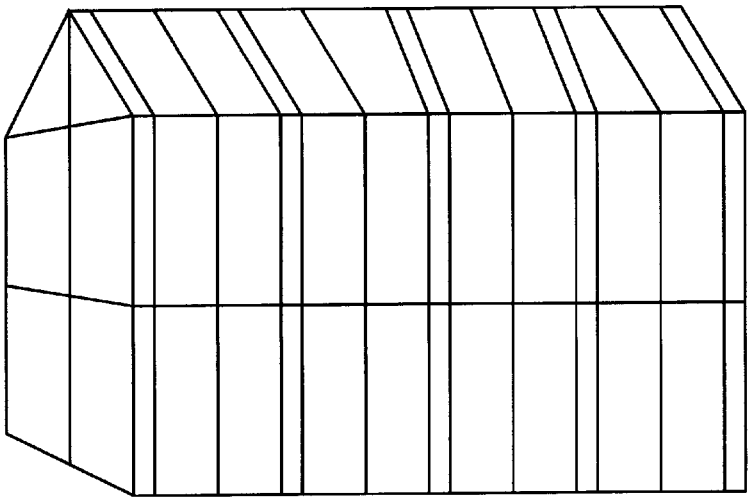
FIG. 7 shows the panels used for a roof and a wall of a pre-fabricated building.

FIG. 7 shows the double-interlocking panels of the present invention used for roof panels and wall panels in a pre-fabricated building. Because of the double-interlocking nature of the panels in the invention, roof panels and wall panels of a building can be made stronger without having to increase the thickness or gauge of the flat stock used to form the panels. Pre-fabricated building would preferably use 22 to 26 gauge metal for the panels, with the panels having a flat stock width of 16 to 24 inches. Using a thinner flat stock to form the panel would save in the cost of fabricating the panels. The double-interlocking feature of the present invention can also be used for acrylic panels used for windows in a roof, where the acrylic is of the clear type to allow sunlight to pass through.

I claim:

1. A double interlocking panel, comprising:

A middle section having a left side and a right side;

A left-side engaging edge connected to the left side of the middle section; and, A right-side engaging edge connected to the right side of the middle section;

The left-side engaging edge consisting of:

An inner offset bend having an angled portion of less than 180 degrees, the inner offset bend being connected to the left side of the middle section:

A lower left strip connected to the inner offset bend; and,

A left flange connected to the lower left strip, the left flange forming a left edge of the panel;

The right-side engaging edge consisting of:

An outer offset bend having an angled portion of less than 180 degrees, the outer offset bend being connected to the right side of the middle section;

A lower right strip connected to the outer offset bend; and,

A right flange connected to the lower right strip, the right flange forming a right edge of the panel.

2. The double interlocking panel of claim 1, and further comprising:

The inner offset bend having the-angled portion located substantially at its center and facing away from the left flange.

3. The double interlocking panel of claim 1, and further comprising:

The angled portion of the inner offset bend being substantially 90 degrees.

4. The double interlocking panel of claim 2, and further comprising:

The outer offset bend having the angled portion located substantially at its center and facing toward the right flange.

5. The double interlocking panel of claim 4, and further comprising:

The angled portion of the outer offset bend being substantially 90 degrees.

6. The double interlocking panel of claim 1, and further comprising:

The left flange, the lower left strip, the lower right strip, and the right flange all having a substantially flat cross-sectional shape.

7. A double interlocking panel, comprising:

A middle section having a left side, a right side, and a substantially flat upper strip;

A left side engaging edge connected to the left side of the middle section of the panel; and, A right side engaging edge connected to the right side of the middle section of the panel;

The left side engaging edge including:

An inner offset bend connected to the left side of the middle section, the inner offset bend having an angled portion of less than 180 degrees facing a direction substantially normal to a plane of the flat upper strip;

A lower left strip connected to the inner offset bend; and,

A left flange connected to the lower left strip;

The right side engaging edge including:

An outer offset bend connected to the right side of the middle section, the outer offset bend having an angled portion of less than 180 degrees facing a direction substantially parallel to a plane of the flat upper strip.

8. The double interlocking panel of claim 7, and further comprising:

The angled portions of the inner offset bend and the outer offset bend both being at substantially 90 degrees.

9. The double interlocking panel of claim 8, and further comprising:

The left flange forming a left edge of the panel, the left flange having a substantially flat and straight cross-sectional shape; and, The right flange forming a right edge of the panel, the right flange having a substantially flat and straight cross-sectional shape.

10. A double interlocking panel, comprising:

A middle section having a left side and a right side and forming a concave shape;

A left flange, the left flange forming a left edge of the panel;

A lower left strip connected to the left flange at an angle of substantially 135 degrees;

An inner offset bend having a first portion and a second portion, the first and section portions being joined to form an angled portion, the first portion of the inner offset bend being connected to the lower left strip at an angle of substantially 135 degrees, the second portion of the inner offset bend being connected to the left side of the middle section at an angle of substantially 90 degrees formed from a top surface of the left side;

A right flange, the right flange forming a right edge of the panel;

A lower right strip connected to the right flange at an angle of substantially 135 degrees; and, An outer offset bend having a first portion and a second portion, the first and second portions being joined to form an angled portion, the first portion of the outer offset bend being connected to the lower right strip at an angle of substantially 135 degrees, the second portion of the outer offset bend being connected to the right side of the middle section at an angle of substantially 270 degrees formed from a top surface of the right side.

11. The double interlocking panel of claim 10, and further comprising:

The left flange, the right flange, the lower left strip, and the lower right strip all have substantially flat cross-sectional shapes.

12. The double interlocking panel of claim 11, and further comprising:

The cross-sectional length of the left flange is substantially equal to the cross-sectional length of the first portion of the outer offset bend;

The cross-sectional length of the right flange is substantially equal to the cross-sectional length of the first portion of the inner offset bend; and, The cross-sectional length of the lower left strip is substantially equal to the cross-sectional length of the lower right strip.

13. A double interlocking panel, comprising:

A middle section including left side and a right side, the middle section forming a concave shape and facing in a first direction;

A left side engaging edge of the panel formed on the left side of the middle section, the left side engaging edge including:

A left flange forming a left side of the panel;

A lower left strip connected to the left flange; and,

An inner offset bend connected between the left side of the middle section and the lower left strip, the inner offset bend having an angled portion facing a direction substantially equal to the first direction;

The left flange, the lower left strip, and an adjacent end of the inner offset bend forming a concave portion facing in a direction opposite to that of the first direction; and, A right side engaging edge of the panel formed on the right side of the middle section, the right side engaging edge including:

A right flange forming a right side of the panel;

A lower right strip connected to the right flange; and,

An outer offset bend connected between the right side of the middle section and the lower right strip, the outer offset bend having an angled portion facing in a direction perpendicular to that of the first direction and toward the right flange.

14. The double interlocking panel of claim 13, and further comprising:

The angled portion of the inner offset bend forming an angle of substantially 90 degrees facing the first direction; and, The angled portion of the outer offset bend forming an angle of substantially 90 degrees facing the right flange.

15. The double interlocking panel of claim 13, and further comprising:

The lower left strip and the lower right strip each have a substantially flat cross-sectional shape of substantially equal length; and, The left flange and the right flange each have a substantially flat cross-sectional shape of substantially equal length.

16. A double interlocking panel, comprising:

A middle section having a left side and a right side;

A left side engaging edge connected to the left side of the middle section,

The left side engaging edge including a left flange, a lower left strip connected to the left flange, and an inner offset bend connected between the left side and the lower left strip;

The right side engaging edge including a right flange, a lower right strip connected to the right flange, and an outer offset bend connected between the right side and the lower right strip;

The inner offset bend having a first portion and a second portion joined together at an angled portion, the first portion being connected to the lower left strip and the second portion extending upward from the left side;

The outer offset bend having a first portion and a second portion joined together at an angled portion, the first portion being connected to the lower right strip and the second portion extending downwardly from the right side;

The left flange having a cross-sectional length and a cross-sectional angle substantially equal to a cross-sectional length and a cross-sectional angle of the first portion of the outer offset bend;

The right flange having a cross-sectional length and a cross-sectional angle substantially equal to a cross-sectional length and a cross-sectional angle of the first portion of the inner offset bend; and, The left flange forming a left side of the panel, and the right flange forming a right side of the panel.

17. The double interlocking panel of claim 15, and further comprising:

The angled portion of the inner offset bend and the outer offset bend being substantially 90 degrees.

18. The double interlocking panel of claim 16, and further comprising:

The angle portion of the inner offset bend facing a direction perpendicular to a plane of the lower left strip; and, The angle portion of the outer offset bend facing a direction parallel to a plane of the lower right strip.

* * * * *